United States Patent [19]

James

[11] Patent Number: 4,529,971

[45] Date of Patent: Jul. 16, 1985

[54] ALARM LOOP SUPERVISION

[75] Inventor: Rolland T. James, Collingswood, N.J.

[73] Assignee: Base Ten Systems, Inc., Trenton, N.J.

[21] Appl. No.: 475,105

[22] Filed: Mar. 14, 1983

[51] Int. Cl.[3] ..... G08B 29/00

[52] U.S. Cl. ..... 340/508; 340/506; 340/509

[58] Field of Search ..... 340/508, 506, 505, 500, 340/512, 513, 518, 517, 509; 179/5 R

[56] References Cited

U.S. PATENT DOCUMENTS 4,253,091 2/1981 Frydman ..... 340/506

4,361,833 11/1982 Allgood ..... 340/506

4,378,554 3/1983 Saigal ..... 340/506

*Primary Examiner*—Donnie L. Crosland

*Attorney, Agent, or Firm*—Weiser & Stapler

[57] ABSTRACT

Apparatus for indicating a break in the lines leading from a base station to a monitored instrumentality. Two pairs of wires conduct signals to each contact of a normally open switch-like element in the monitored instrumentality (the closure of which signifies an alarm condition) and return these signals to the base station. The presence or absence of the return signals at predetermined times indicates the condition of the lines and also an alarm condition, even if one of the lines leading to the instrumentality is broken.

14 Claims, 3 Drawing Figures

ALARM LOOP SUPERVISION

Figure 1:
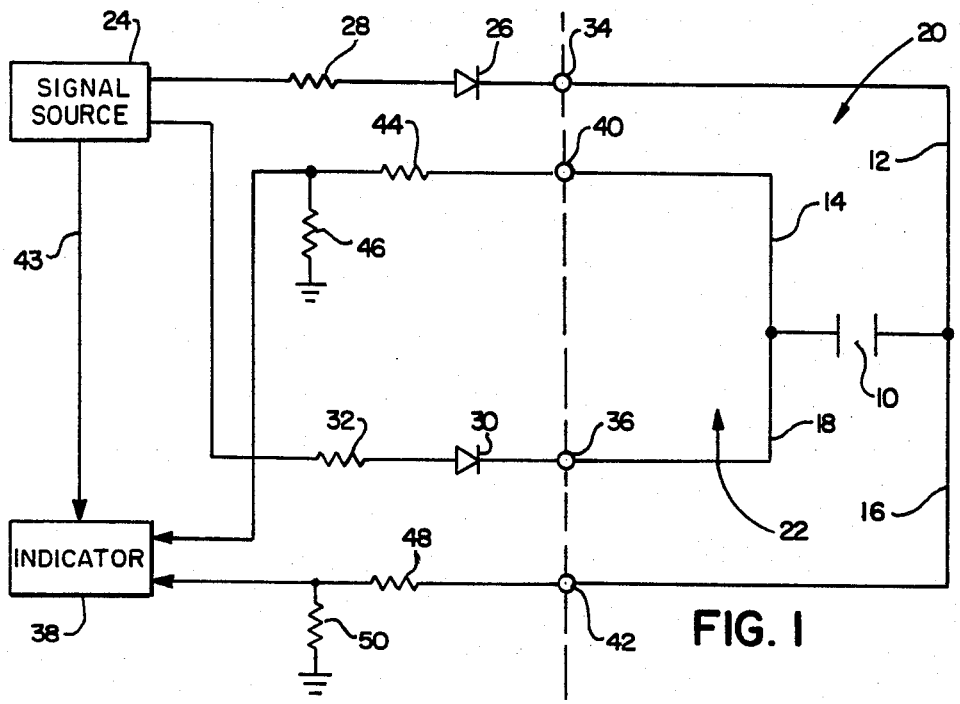

This invention relates to apparatus for use in a system in which a telephone network provides not only the traditional voice communication between subscribers, but also automatic monitoring of the condition of one or more instrumentalities located at subscriber premises. More particularly, the present invention relates to apparatus which enhances the reliability of such automatic monitoring, especially with respect to faults which can occur in the connections between a specific instrumentality being monitored, and the remainder of the equipment which is located at the subscriber's premises for monitoring purposes.

Many systems have been proposed for providing the overall monitoring under discussion. These systems are generally characterized by having some special equipment located at the subscriber's premises, which senses the condition of the instrumentality or instrumentalities to be monitored, and then transmits electrical signals indicative of that condition to some other location in the telephone network—typically to a central surveillance station—where these signals are utilized as appropriate.

One such system is described in a copending U.S. patent application, Ser. No. 327,486, filed Dec. 4, 1981, now U.S. Pat. No. 4,442,320, dated Apr. 10, 1984, and assigned to the same assignee as the present invention.

The instrumentality whose condition is to be monitored in such systems is typically of the "off-on" variety. For example, it may be a fire alarm, or a burglar alarm, either of which would be in only one of two conditions, namely off or on, at any given time. This off-on characteristic is associated, electrically, with the opening and closing of what are in effect the contacts of a switch. Thus, in a fire alarm situation, there may be a fusible alloy, which melts if heated by a fire, enabling contacts to close, thereby acting like a switch going from the open to the closed state. Likewise, a burglar alarm may be so constructed that unauthorized entry into the protected premises causes contacts to close, which is again the electrical equivalent of a switch being closed. This change in state is then electrically sensed by applying a voltage across the switch-like element, and detecting the change which occurs when the element changes state so as to indicate an alarm.

The problem which has arisen, in prior art equipment of this general type, is that other changes can occur, which either prevent an alarm-caused change in the switching element from being detected, or which conversely simulate such an alarm-caused change, and therefore create a false alarm indication. This occurs as follows.

Assume that the switch-like element is open when no alarm condition exists, but closes when an alarm condition arises. This switch-like element is conventionally connected between (across) two electrical wires (sometimes called a "loop") which extend from the element itself to some other location at the subscriber's premises, where there are located, either within the telephone instrument enclosure itself, or within a separate cabinet, all of the other parts of the subscriber terminal portion of the over-all system. These other parts may include filtering means for selecting signals in desired frequency ranges for the overall system operation, signal processing circuitry for deriving from and conveying to the central location information concerning the status of the system and of the instrumentalities being monitored at the particular subscriber's premises, power supply circuitry including a standby power supply in the form of a battery, and so forth. All this equipment is normally concentrated at one spot at the subscriber's premises, whereas the instrumentalities being monitored are normally not concentrated at that same spot, but rather are normally distributed about the subscriber premises, as their intended functions require.

Thus a fire alarm may be located several rooms, or even several floors away from the cabinet housing the other apparatus mentioned above, or even in other buildings, as where a farming complex is involved with outlying barns, sheds and the like. The same would, of course, also apply to burglar alarms, and other monitored instrumentalities.

The problem previously mentioned—and to which the present invention provides the solution—arises when the connecting wires (the loop) between the cabinet and the outlying instrumentalities' switching element are disturbed. For example, such a wire can break. If it does, then the break will "act" like an open switch, and will continue to so act even after the actual switching element has changed from the open to the closed state in response to an alarm condition. This alarm condition will therefore remain completely unnoticed, and the utilitiy of the overall system will thereby be completely negated.

It is also noted that the occurrence of such a break is by no means an event which is so unlikely as to be no cause for concern. The wires in question often have to be strung in relatively exposed locations, and the risk goes up further as their length increases. The type of overall system under consideration is frequently used by subscribers in relatively remote geographical locations, where automatic monitoring is particularly desirable due to the sparseness of population available to provide human monitoring. In such remote locations, the land area occupied by any particular subscriber is apt to be quite large (e.g. a farm), and different buildings (barns, etc.) are likewise apt to be quite distant from one another. Thus, long wire runs (loops) tend to be prevalent between the individual instrumentalities to be monitored, and the place where the cabinet which houses the common portion of the apparatus is located.

Most importantly, however, is the fact that the whole system is geared to providing warning of events which can be of extreme seriousness, and even fatal. Therefore, even infrequent occurrences of loop wire breaks represent a serious problem, since they would defeat the whole purpose of the system, which is to provide monitoring that is truly reliable and that is protected even against infrequent malfunctions.

Accordingly, it is an object of the present invention to provide apparatus which is less subject to the prior art problems described above.

It is another object to provide apparatus for electrically monitoring the condition of one or more instrumentalities, and which is less subject to failure than in the prior art.

It is another object to provide such monitoring apparatus which is less subject to failure due to trouble with the wire loop connection between the switch-like element which actually does the monitoring and the remainder of the apparatus.

It is still another object to provide such apparatus which particularly protects the functioning of the apparatus in the face of breaks in said connecting wires.

It is still another object to provide such apparatus for use in an overall system for providing remote monitoring of the said instrumentalities over a conventional telephone network.

It is still another object to provide such apparatus which is particularly suitable for use with digital signal processing.

It is still another object to provide such apparatus in which the location of the wire break can also be isolated to particular wire segments.

These and other objects which will appear are achieved in accordance with the present invention as follows.

Each switch-like element is connected, not across a pair of single wires, i.e. one loop, extending between it and the cabinet which houses the common portions of the monitoring apparatus, as had been done in the prior art, but across two loops of wires, whose open ends terminate at the common apparatus. Intermittently, a potential is applied across one closed loop. During periods when that potential is not applied, a potential is applied across the other closed loop. Electrical isolation is provided between the loops, so that there can be cross-feed between them only through the switch-like element.

It can be shown (and will be shown later in this Specification) that this arrangement makes it possible to derive signals from these loops which unambiguously indicate whether the switch-like element is open or closed, irrespective of whether there is a break somewhere in the wires forming the two closed loops. Moreover, these same derived signals can be used to indicate whether a break (if one exists) is in one loop or in the other.

Preferably, one end of each loop is connected to a common circuit reference point through a voltage divider network, and the required potentials are applied to the other end, through isolating diodes. The potentials sensed at the voltage dividers then are further processed to derive the information which they bear, concerning the state of the switch-like element and also the presence and location of a possible break in the wire loops.

Figure 3:
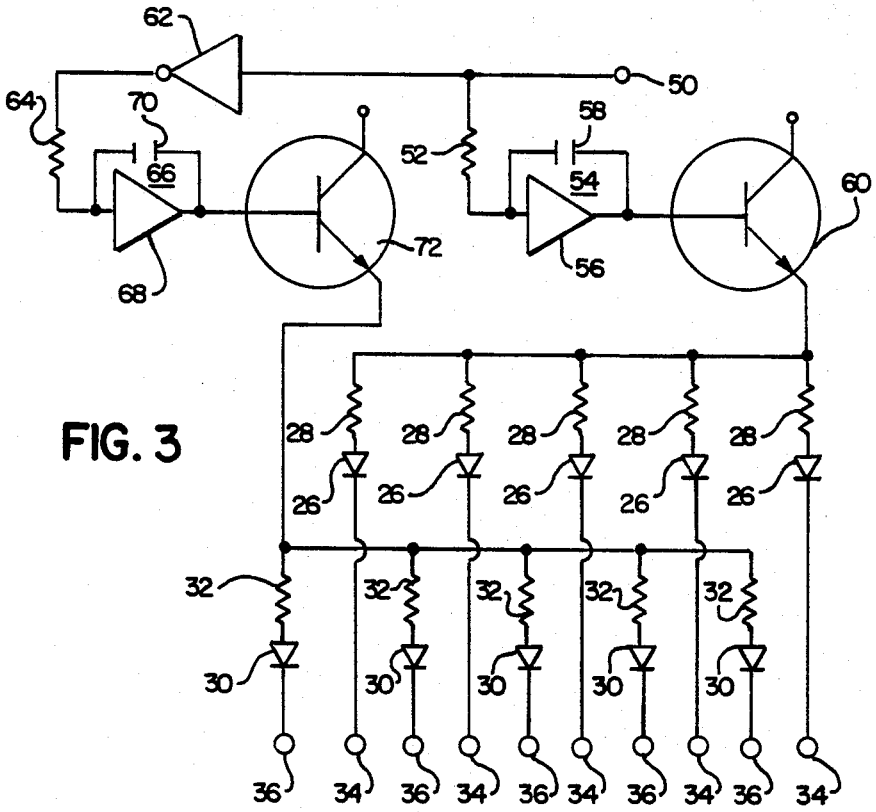
Figure 2:
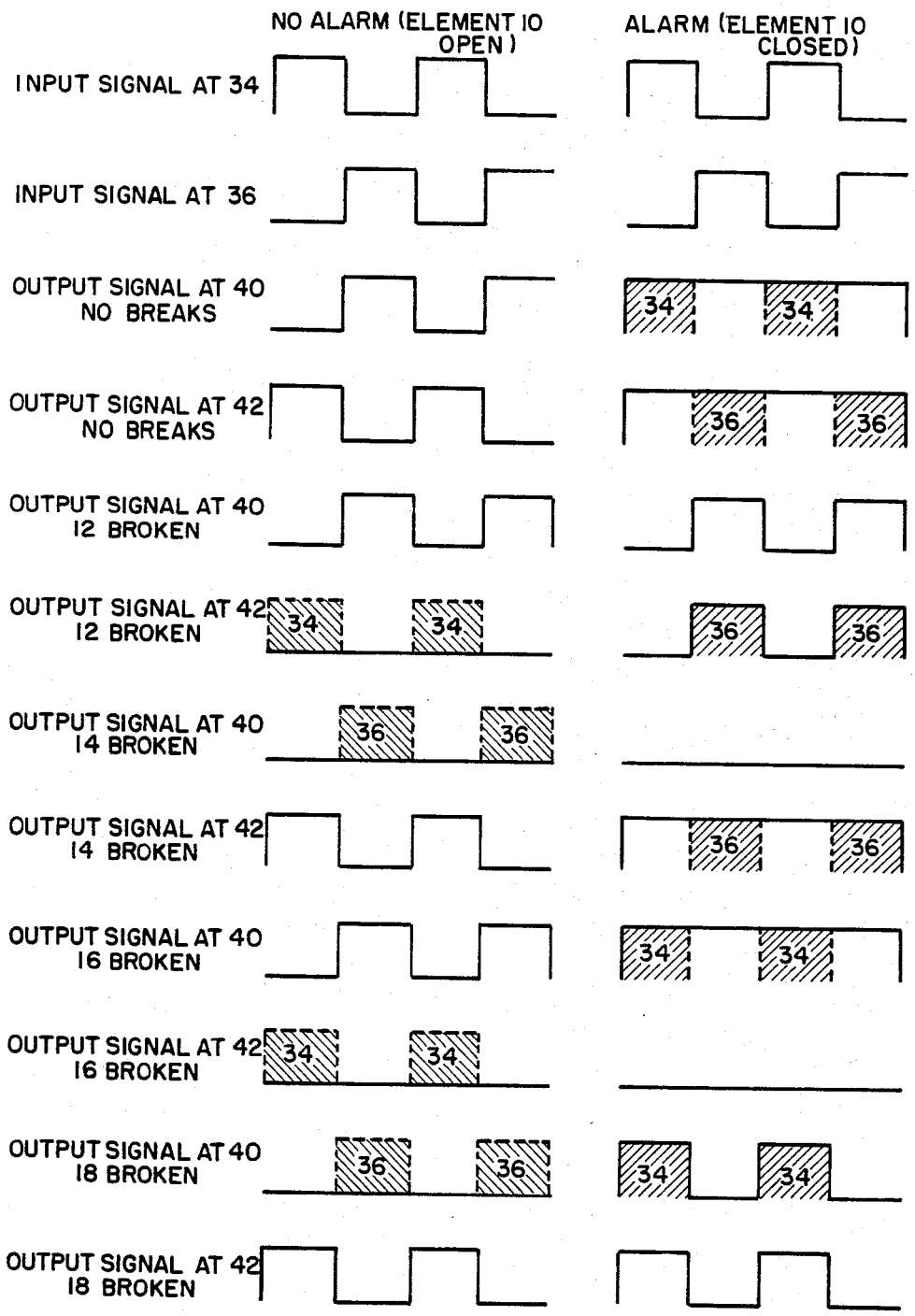

For further details, reference is made to the discussion which follows, in light of the accompanying drawings, wherein FIG. 1 is a circuit diagram of an embodiment of the present invention;

FIG. 2 shows a number of waveforms useful in understanding the operation of FIG. 1; and FIG. 3 shows additional details of circuitry embodying the invention.

The same reference numerals are used to designate corresponding elements in the Figures.

Referring to FIG. 1, this shows a switch-like element 10, symbolizing an instrumentality located at a telephone subscriber's premises and intended to be remotely monitored by the type of overall system which is the general subject of this invention. For example, element 10 may be the contacts associated with the fusible link of a fire alarm, which it is desired to monitor.

It will be understood that, in an actual system, there may be a multiplicity of such instrumentalities to be monitored at a given subscriber's premises. However, for explanation of the principles involved, a single such instrumentality suffices.

In accordance with the present invention, there are connected between element 10 and the remainder of the equipment at the subscriber's location, not the conventional two electrical leads (i.e. one loop), but rather four electrical leads (i.e. two loops). Thus, element 10 has connected to it four leads 12, 14, 16 and 18.

These leads connected to element 10 are short-circuited in pairs in the vicinity of the point at which they are connected to that element. Thus, in FIG. 1, the pair of leads 12 and 16 is so short-circuited, and the pair of leads 14 and 18 is likewise short-circuited. Thus, there are formed two loops 20 and 22, loop 20 consisting of leads 12 and 16, and the other loop 22 consisting of leads 14 and 18. The switch-like element 10 is connected between (across) these two loops.

One end of each loop, (i.e. the free ends of leads 12 and 18) is connected to a signal source 24 through diode 26 and resistor 28 and through diode 30 and resistor 32, respectively. Terminals 34 and 36 represent the connections of these leads 12 and 18 to the remainder of the equipment at the subscriber's location.

Signal source 24 supplies signals which vary periodically between a high and low potential value. This source 24 is so constructed that, at the time when the high value of potential is applied via its input terminal 34 to loop 20, the low value is applied via its input terminal 36 to loop 22, and vice versa.

These signals supplied by source 24 are represented by the top-most two waveforms in both the left-hand and the right-hand portions of FIG. 2, identified as INPUT SIGNAL AT 34 and INPUT SIGNAL AT 36. Each signal is composed of a repetitive train of pulses, with the pulses of each train occurring between the pulses of the other train. The signals are preferably substantially identical but 180° out of phase.

The opposite ends of loops 20 and 22, i.e. the free ends of leads 14 and 16, are connected to the inputs of indicator 38, which senses the presence of signals (if any) that reach the respective output terminals 40 and 42 as a result of the signals supplied by signal source 24. More specifically, voltage dividers 44, 46 and 48, 50 are associated with output terminals 40 and 42, respectively, and separately couple the signals, if any, at the opposite contacts of element 10 to detection means within indicator 38.

The signals so produced at output terminals 40 and 42, for different conditions of element 10 and leads 12, 14, 16 and 18, are represented by the remaining waveforms in FIG. 2, identified as appropriate as OUTPUT SIGNAL AT 40 and OUTPUT SIGNAL AT 42. The left-hand waveforms represent the output signals at terminals 40 and 42 for a "no alarm" state, namely element 10 being open, while the right-hand waveforms represent the output signals at terminals 40 and 42 for an "alarm" state, namely element 10 being closed.

Consider first the various conditions which can arise at output terminals 40 and 42 in the "no alarm" state of switch-like element 10. If there are no breaks anywhere in loops 20 and 22, the input signal at terminal 34 is conducted through leads 12 and 16 to output terminal 42 and the input signal at terminal 36 is conducted through leads 18 and 14 to output terminal 40. This is represented in the left-hand portion of FIG. 2 by the third and fourth waveforms from the top, which are identical to the input signal waveforms at terminals 34 and 36.

In sharp contrast, a break in either of the loops 20 or 22 prevents the input signal to that loop from reaching its associated output terminal which is manifested by an absence of the input signal at its associated output terminal.

Specifically, a broken lead in loop 20 (consisting of leads 12 and 16) results in no output signal appearing at terminal 42 in a "no alarm" state. This is represented by the solid-line, no-output signal in the two waveforms labeled "OUTPUT SIGNAL AT 42-12 BROKEN" and "OUTPUT SIGNAL AT 42-16 BROKEN" in the left-hand column of waveforms in FIG. 2.

The absence at output terminal 42 of the input signal applied to terminal 34 is highlighted by the diagonally shaded boxes 34 in these two waveforms. Please note that these boxes show only where output signals would have been presented, if there had been no wire break. Since there is a break, there are no such signals and the boxes 34 represent their absence.

Similarly, a broken lead in loop 22 (consisting of leads 14 and 18) results in no output signal at terminal 40 in a "no alarm" state. This is represented by the solid-line, no-output signal in the two waveforms labeled, "OUTPUT SIGNAL AT 40-14 BROKEN" and "OUTPUT SIGNAL AT 40-18 BROKEN" in the left-hand column of waveforms in FIG. 2. Again, the absence at output terminal 40 of the input signal applied to terminal 36 is highlighted by the diagonally shaded boxes 36 in these two waveforms.

The separate connection 43 between signal source 24 and indicator 38 provides for the sampling of the signals at the output terminals at the times that the respective input signal pulses at the terminal 34 and terminal 36 are generated by the signal source. Specifically, as the input signal is applied at terminal 34, signal source 24 conditions indicator 38 to be capable of sensing the corresponding signal at output terminal 42. The presence of such a signal at output terminal 42 at these times (e.g., left-hand waveforms "OUTPUT SIGNAL AT 42-NO BREAKS", "OUTPUT SIGNAL AT 42-14 BROKEN", and "OUTPUT SIGNAL AT 42-18 BROKEN") indicates that there are no breaks in loop 20, while the absence of such a signal at output terminal 42 at these times indicates that there is a break in either lead 12 or lead 16.

It will be apparent that these time-coordinated sensings of the presence or absence of output signals can be accomplished by any of a variety of conventional sampling means, controlled by connection 43. Similarly, as the input signal is applied at terminal 36, signal source 24 conditions indicator 38 to be capable of sensing that corresponding signal at output terminal 40. The presence of a signal at output terminal 40 at these times (e.g., left-hand waveforms "OUTPUT SIGNAL AT 40-NO BREAKS", "OUTPUT SIGNAL AT 40-12 BROKEN", and "OUTPUT SIGNAL AT 40-16 BROKEN") therefore indicates that there are no breaks in loop 22, while the absence of such a signal at output terminal 40 at these times indicates that there is a break in either lead 18 or lead 14.

Consider now instead an "alarm" state, which is manifested by the closing of contacts in switch-like element 10. When that happens, input signals applied at terminals 34 and 36 in effect "cross over" from one loop to the other through this now-closed element 10. Therefore, in the absence of any breaks in either loop 20 or 22, the input signal to loop 20 applied at input terminal 34 is conducted not only to output terminal 42 of the same loop 20, as before, but also to output terminal 40 of loop 22. Similarly the input signal to loop 22, applied at input terminal 36, is conducted not only to output terminal 40 of the same loop 22, but also to output terminal 42 of loop 20. This situation is represented by those right-hand waveforms in FIG. 2 which are identified as "OUTPUT SIGNAL AT 40-NO BREAKS" and "OUTPUT SIGNAL AT 42-NO BREAKS". As the alternating input signals are applied to their respective input terminals, they, in effect, cause continuous output signals to be developed at the output terminals. The noteworthy parts of these output signals are those which result from the cross-overs through element 10. These are highlighted by the diagonally shaded boxes 34—which indicate a cross-over of the input signal at terminal 34 to output terminal 40—and the diagonally shaded boxes 36—which indicate a cross-over of the input signal at 36 to output terminal 42. Note that, in this instance, the diagonally shaded boxes 34 and 36 represent signals which are present at the output terminals (not signals which are absent, as was the case for the vertically shaded boxes 34 and 36 previously discussed).

Even with any one of the leads 12, 14, 16 or 18 broken, one or the other of the input signals at terminal 34 or terminal 36 still is able to cross over from one loop to the other loop in an alarm state and this cross-over is therefore sensed by indicator 38. This is highlighted by the other diagonally shaded boxes in the right-hand waveforms of FIG. 2, identified as "OUTPUT SIGNAL AT 42-12 BROKEN", "OUTPUT SIGNAL AT 42-14 BROKEN", "OUTPUT SIGNAL AT 40-16 BROKEN", and "OUTPUT SIGNAL AT 40-18 BROKEN". The diagonally shaded boxes 36 of the first two of these last-mentioned four waveforms indicate a cross-over of the input signal at terminal 36 to output terminal 42. The diagonally shaded boxes 34 of the last two of these waveforms indicate a cross-over of the input signal at terminal 34 to output terminal 40. Again, signal source 24 conditions indicator 38 via connection 43 to be capable of sensing the presence of the input signals applied to one loop at the output terminals of the other loop at the appropriate times. When such presence is sensed, an "alarm" state is indicated.

The foregoing detailed description of the different states of element 10 and conditions of leads 12, 14, 16 and 18, and of the way in which all these are indicated, may be summarized in the following Table:

| | Lead 12 BROKEN | Lead 14 BROKEN | Lead 16 BROKEN | Lead 18 BROKEN |
|---|---|---|---|---|
| NO ALARM | Absence of terminal 34 input signal at terminal 42 | Absence of terminal 36 input signal at terminal 40 | Absence of terminal 34 input signal at terminal 42 | Absence of terminal 36 input signal at terminal 40 |
| ALARM | Presence of terminal 36 input signal at terminal 42 | Presence of terminal 36 input signal at terminal 42 | Presence of terminal 34 input signal at terminal 40 | Presence of terminal 34 input signal at terminal 40 |

Diodes 26 and 30 serve to prevent undesired cross-feed between loops 20 and 22, except through element 10 when closed. Such cross-fed could otherwise prevent the system from functioning as described or reduce its reliability when more than one set of loops are driven by one signal source 24 (See FIG. 3).

Turning now to FIG. 3, this shows in more detail the circuitry which may be used as signal source 24 to develop the input signals applied to input terminals 34 and 36. A square-wave, developed by a square-wave generator of conventional construction and operation (not shown), is applied at input terminal 50. This square-wave is coupled through a resistor 52 to an integrator 54 composed of an amplifier 56 and a capacitor 58. The integrator serves to modify the leading and trailing edges of the square-wave to make them more gradual, to prevent abrupt changes in the signals conducted through loops 20 and 22 from causing radiation from these loops. Incidentally, it is therefore to be understood that the signals represented in the waveforms of FIG. 2, although shown as having vertical leading and trailing edges to simplify the explanation, in practice preferably have more rounded corners and move gradually sloping leading and trailing edges.

This (modified) square-wave signal is applied through a transistor 60 and resistors 28 to diodes 26, which pass only the positive going portions of the signal to a plurality of input terminals 34.

The square-wave applied at terminal 50 is inverted by an inverter 62 and the inverted square-wave is coupled through a resistor 64 to an integrator 66 composed of an amplifier 68 and a capacitor 70. Integrator 66 serves the same purpose as integrator 54.

The modified, inverted square-wave is applied through a transistor 72 and resistors 32 to diodes 30 which pass only positive going portions of the signal to a plurality of input terminals 36. Any two terminals 34 and 36 in FIG. 3 then are capable of being connected to the switch-like element 10 of an instrumentality, and thence further to an indicator 38 via a corresponding pair of output terminals 40 and 42 (see FIG. 2).

Purely for illustration, five such pairs of input terminally 34 and 36 are shown in FIG. 3. This highlights the fact that a single input circuit such as that illustrated in block diagram form at 24 in FIG. 2, and in more detail in FIG. 3, can drive the loops which service a plurality—and preferably all—the instrumentalities at a given subscriber's location.

Other numbers of such pairs may be provided as required, depending on the number of instrumentalities under surveillance.

Moreover, it should be noted that it is not necessary to use a completely different pair of terminals 34 and 36 in FIG. 3 for each such instrumentality. Rather, any one of terminals 34 can cooperate with two other terminals 36 to form three loops, two loops 22 (FIG. 2) and one loop 20 (FIG. 2). By connecting two different elements 10 (FIG. 2) between the single loop 20 and the two different loops 22, respectively, the capacity of the circuitry shown in FIG. 3 to accommodate elements 10 is nearly doubled. Indeed, the N pairs of terminals 34, 36 can accommodate 2N-1 elements 10.

It will be understood that various alternative embodiments will occur to those of ordinary skill in the art without departure from the spirit or scope of the present invention.

I claim:

1. Apparatus for monitoring the condition of an instrumentality comprising:

an instrumentality having a normally open switch-like element;

first and second leads connected to a first contact of said element;

third and fourth leads connected to a second contact of said element;

means for simultaneously supplying a first electrical signal to said first contact of said element through said first lead and a second electrical signal to said second contact of said element through said third lead;

and means connected to said first contact of said element through said second lead and to said second contact of said element through said fourth lead for simultaneously indicating the presence of said first electrical signal at either said first contact of said element or said second contact of said element, and the presence of said second electrical signal at either said second contact of said element or said first contact of said element.

2. Apparatus according to claim 1 wherein said first electrical signal is a first series of pulses and said second electrical signal is a second series of pulses, the pulses in said second series occurring between the pulses in said first series.

3. Apparatus according to claim 1 wherein said first electrical signal and said second electrical signal are identical repetitive trains of pulses 180° out of phase.

4. Apparatus according to claim 2 wherein said indicating means include first detection means connected to said first contact of said element through said second lead for sensing the presence of said first electrical signal or said second electrical signal at said first contact of said element and second detection means connected to said second contact of said element through said fourth lead for sensing the presence of said second electrical signal or said first electrical signal at said second contact of said element.

5. Apparatus according to claim 1 wherein said signal supplying means include a first means through which said first electrical signal is conducted and by which said second electrical signal is blocked and a second means through which said second electrical signal is conducted and by which said first electrical signal is blocked.

6. Apparatus according to claim 5 wherein said first means is a first diode and said second means is a second diode.

7. Apparatus for monitoring the condition of an instrumentality comprising;

a first wire loop;

a second wire loop;

an instrumentality having a normally open switch-like element connected between said first and said second wire loops at selected points along their length;

signal supply means connected to a first end of said first wire loop and to a first end of said second wire loop for simultaneously supplying a first electrical signal to one contact of said element and a second electrical signal to a second contact of said element;

and means connected to the second end of said first wire loop and to the second end of said second wire loop for simultaneously detecting the presence of said first electrical signal at either contact of said element and the presence of said second electrical signal at either contact of said element.

8. Apparatus according to claim 7 wherein said detecting means include a first input connected to said second end of said first wire loop and to said second wire loop through said element and a second input connected to said second end of said second wire loop and to said first wire loop through said element.

9. Apparatus according to claim 8 wherein said first electrical signal is a first series of pulses and said second electrical signal is a second series of pulses, the pulses in said second series occurring between the pulses in said first series.

10. Apparatus according to claim 8 wherein said first electrical signal and said second electrical signal are identical repetitive trains of pulses 180° out of phase.

11. Apparatus according to claim 1 wherein said first electrical signal and said second electrical signal are substantially continuously supplied to the contacts of said element.

12. Apparatus according to claim 7 wherein said first electrical signal and said second electrical signal are substantially continuously supplied to the contacts of said element.

13. Apparatus for monitoring the condition of an instrumentality comprising:

an instrumentality having a normally open switch-like element;

lead pairs electrically associated with said element and including;

first and second leads connected to a first contact of said element;

third and fourth leads connected to a second contact of said element; and means for detecting a break in any of said leads or in either of said lead pairs, including;

means for simultaneously supplying a first electrical signal to said first contact of said element through said first lead and a second electrical signal to said second contact of said element through said third lead; and means connected to said first contact of said element through said second lead and to said second contact of said element through said fourth lead for simultaneously indicating the presence of said first electrical signal at either said first contact of said element or said second contact of said element, and the presence of said second electrical signal at either said second contact of said element or said first contact of said element, respectively.

14. Apparatus for monitoring the condition of an instrumentality comprising;

a first wire loop;

a second wire loop;

an instrumentality having a normally open switch-like element connected between said first and said second wire loops at selected points along their length to define two lead pairs, each including a portion of said first wire loop and a portion of said second wire loop;

signal supply means connected to a first end of said first wire loop and to a first end of said second wire loop for simultaneously supplying a first electrical signal to one contact of said element and a second electrical signal to a second contact of said element; and indicator means including;

means connected to the second end of said first wire loop and to the second end of said second wire loop for simultaneously detecting the presence of said first electrical signal at either contact of said element and the presence of said second electrical signal at either contact of said element; and alarm means operatively associated with said detecting means, for providing an indication of the occurrence of a break in either of said loops or in either of said lead pairs.

* * * * *